US007227509B2

(12) United States Patent
Saito et al.

(10) Patent No.: US 7,227,509 B2
(45) Date of Patent: Jun. 5, 2007

(54) ANTENNA DEVICE

(75) Inventors: Yutaka Saito, Nomi-gun (JP); Hiroyuki Uno, Ishikawa-gun (JP); Genichiro Ota, Miura (JP); Hiroshi Haruki, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 22 days.

(21) Appl. No.: 10/542,783

(22) PCT Filed: Jan. 16, 2004

(86) PCT No.: PCT/JP2004/000274

§ 371 (c)(1),
(2), (4) Date: Jul. 20, 2005

(87) PCT Pub. No.: WO2004/068635

PCT Pub. Date: Aug. 12, 2004

(65) Prior Publication Data

US 2006/0071870 A1 Apr. 6, 2006

(30) Foreign Application Priority Data

Jan. 30, 2003 (JP) ..... 2003-022369

(51) Int. Cl.
*H01Q 19/10* (2006.01)

(52) U.S. Cl. ..... 343/834

(58) Field of Classification Search ..... 343/834, 343/805, 806, 767, 770, 700 M, 795, 733
See application file for complete search history.

(56) References Cited

U.S. PATENT DOCUMENTS 4,044,360 A * 8/1977 Wolfson et al. ..... 343/754

(Continued)

FOREIGN PATENT DOCUMENTS

EP 0604304 6/1994

(Continued)

OTHER PUBLICATIONS

European Search Report dated Nov. 17, 2005.

(Continued)

*Primary Examiner*—Hoanganh Le
*Assistant Examiner*—Huedung Mancuso
(74) *Attorney, Agent, or Firm*—Stevens, Davis, Miller & Mosher, LLP

(57) ABSTRACT

Linear elements 101*a* to 101*d* are conductors, which have the element length equivalent to half a wavelength, have been placed so that they may draw a diamond shape. Delay elements 102*a* and 102*b* are bent conductors, which have a total length equivalent to one fourth wavelength and a length L2 equivalent to one eighth. The linear elements 101*a* and 101*c* are connected one another via the delay element 102*a*, while the linear elements 101*b* and 101*d* are connected one another via the delay element 102*b*. A feeding section 103 is connected to each of the ends of the linear elements 101*a* and 101*b* for feeding power to them. Between the tips of the linear elements 101*c* and 101*d*, a gap with a length L3 is left. A reflector 104 has been placed at a distance h from a diamond-shape antenna with delay elements along the −Z axis, the distance h being equivalent to 0.42 wavelength. This achieves the antenna device, which may be suitably mounted on any of small wireless apparatuses and form a primary beam, of which horizontally-polarized wave or vertically-polarized wave tilts toward the horizontal direction.

10 Claims, 14 Drawing Sheets

U.S. PATENT DOCUMENTS

| | | | | |
|---|---|---|---|---|
| 5,404,146 | A * | 4/1995 | Rutledge | 343/720 |
| 5,914,693 | A | 6/1999 | Takei et al. | 343/767 |
| 6,163,306 | A * | 12/2000 | Nakamura et al. | 343/797 |
| 6,573,874 | B1 | 6/2003 | Saito et al. | |
| 6,753,826 | B2 * | 6/2004 | Chiang et al. | 343/834 |
| 6,759,988 | B2 * | 7/2004 | Purr et al. | 343/700 MS |
| 6,836,255 | B1 * | 12/2004 | Davis | 343/781 P |
| 6,861,988 | B2 * | 3/2005 | Gabriel et al. | 343/700 MS |
| 7,015,871 | B2 * | 3/2006 | Gottl et al. | 343/882 |
| 2003/0043084 | A1 * | 3/2003 | Egashira | 343/767 |

FOREIGN PATENT DOCUMENTS

| | | |
|---|---|---|
| EP | 1150381 | 10/2001 |
| JP | 7273541 | 10/1995 |
| JP | 11355030 | 12/1999 |

OTHER PUBLICATIONS

PCT International Search Report dated Apr. 27, 2004.

T. Kawamura, et al.; "A Planar-Type Multi-Sector Antenna Consisting of Slot Yagi-Uda Array," IEICE B vol. J85-B No. 9, Sep. 2002, pp. 1633-1643 with partial English translation.

Y. Saito, et al.; "Design and analysis of the Open Ended Diamond Antenna," IEICE B vol. J82-B No. 10, Oct. 1999, pp. 1915-1922 with partial English translation.

* cited by examiner

VIEW ON ARROW "A"

VIEW ON ARROW "A"

ANTENNA DEVICE

TECHNICAL FIELD

The present invention relates to an antenna device used in mobile communications, which may be suitably applied to, for example, fixed wireless apparatuses and wireless terminals configured in a wireless LAN system.

BACKGROUND ART

In wideband wireless communications through, for example, a wireless LAN system, such a problem has arisen that the quality of transmission is deteriorated due to multi-path fading or shadowing, especially in indoor applications. For this reason, it is required to develop a directive antenna mounted on a wireless apparatus capable of being controlled so that a primary beam radiated from it may advance toward any direction to maintain the quality of transmission at a moderate level even in a poor radio-wave propagation environment affected by multi-path fading or shadowing.

In addition, it is further required that an antenna, which is mounted on a notebook-PC type of terminal wireless apparatus for using on a desk or on a fixed type of wireless apparatus attached to a ceiling, has a planar structure because of these apparatuses' configurations. It is also required that the elevation angle of a primary beam tilts toward the horizontal direction from the vertical direction relative to the antenna plane.

As an example of a sector antenna providing such a radiation characteristic, a Yagi-Uda slot array planar multi-sector antenna has been disclosed in Journal of the Institute of Electronics, Information and Communication Engineers of Japan (IEICE) ((B) Vol. J85-B, No. 9, pp. 1633-1643, 2002). In the following paragraphs, the sector antenna is briefly described.

FIG. 1 is a plan view showing the configuration of a conventional sector antenna. As shown in the figure, each of slot arrays 11*a* to 11*f* has five-element slots vertically placed. The sector antenna has a configuration, in which the slot arrays 11*a* to 11*f* are placed in a radial pattern, drawing a circle. The primary beam radiated from each (for example, 11*a* alone) of the slot arrays, of which elevation angle θ tilts at any angle between 45° and 60° relative to the vertical plane, advances toward a horizontal plane. By placing these slot arrays at an interval of 60° relative to the horizontal plane (XY plane) and selectively feeding power to any of slot arrays 11*a* to 11*f*, the directivity of the primary beam can be switched among the sectors, each having an angle of 60° (360°÷6) The dimension of the sector antenna is 198 mm (equivalent to 3.3 wavelength) in diameter L17 and 30790 $mm^2$ in area, assuming that the operating frequency of the antenna device is, for example, 5 GHz.

As another type of antenna, an end-open diamond-shape antenna, has been disclosed in the patent document JP-A No. 355030/1999 and Journal of the Institute of Electronics, Information and Communication Engineers of Japan (IEICE) ((B) Vol. J82-B, No. 10, pp. 1915 to 1922, 1999). FIG. 2 is a plan view showing the configuration of a conventional diamond-shape antenna. As shown in the figure, linear elements 21 and 22, each of which has a length equivalent to one wavelength of the operating frequency and has been bent at its center at a given angle, are placed so that they draw a diamond shape with a gap left between their apexes. In the case of this type of antenna, by feeding power at a feeding point 23, the primary beam advancing along a Z-axis perpendicular to the antenna plane (XY plane), may be obtained.

The conventional Yagi-Uda slot array planar multi-sector antenna aforementioned, however, has such a problem that it is difficult to mount on small size wireless apparatuses because the dimension of its plane incorporating six sectors is large and furthermore, the sectors need to be placed so that they may draw a circle.

Besides, the conventional end-open diamond-shape antenna aforementioned, of which primary beam advances in the direction perpendicular to the antenna plane, thereby does not tilt horizontally, has such a problem that it may not suitably mounted on the notebook-PC type of wireless terminal or the fixed wireless apparatus attached to the ceiling.

DISCLOSURE OF INVENTION

An object of the present invention is to provide an antenna device, which may be suitably mounted on any of small wireless apparatuses and forms a primary beam, of which horizontally-polarized wave or vertically-polarized wave tilts toward the horizontal plane.

The object of the present invention aforementioned may be achieved by placing each of the delay elements at one of the opposite apex pairs and a reflector is inserted at a given distance in parallel to the antenna plane, on which the elements have been placed in the case of the end-open diamond-shape antenna, of which each side has a length equivalent to half a wavelength.

BEST MODE FOR CARRYING OUT THE INVENTION

Now, preferred embodiments of the present invention re mentioned in reference to accompanying drawings.

EMBODIMENT 1

Figure 3:
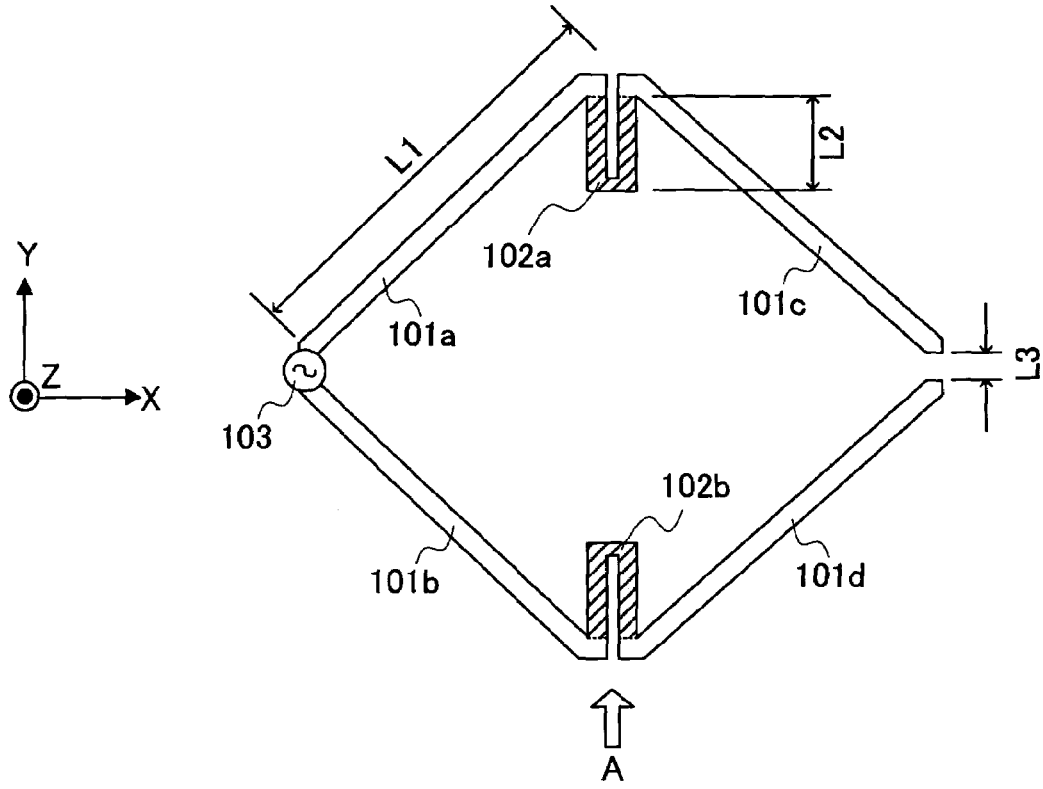
FIG. 3 is a view showing the configuration of an antenna device according to Embodiment 1 of the present invention.
Figure 3:
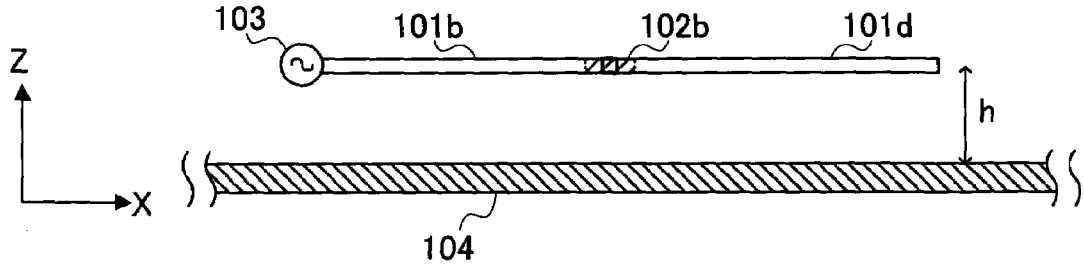

FIG. 3 is a view showing the configuration of an antenna device according to an embodiment 1 of the present invention. In the following paragraphs, the configuration of the antenna device according to the embodiment 1 is mentioned, assuming that the operating frequency of the antenna is 5 GHz.

Linear elements 101*a* to 101*d* are conductors having an element length L1 equivalent to half a wavelength (30 mm) and an element width, for example, 1 mm. These linear elements 101*a* to 101*d* are placed so that they may draw a diamond shape together as shown in FIG. 3.

In the figure, delay elements 102*a* and 102*b* are conductors, which have been bent at a point equivalent to one eighth wavelength (7.5 mm), have a total length equivalent to one fourth wavelength (15 mm) and an element width of 1 mm, wherein a length L2 indicates the length of one of their longitudinal sides. The linear elements 101*a* and 101*c* are connected one another via the delay element 102*a*, while the linear elements 101*b* and 101*d* are connected one another via the delay element 102*b*.

A feeding point 103 is connected to one end of the linear element 101*c* and one end of the linear element 101*a* for feeding power to them. Note that a gap of length L3 is left between the tips of the linear elements 101*c* and 101*d*.

The diamond-shape antenna shown in FIG. 3 is composed of the linear elements 101*a* to 101*d*, the delay elements 102*a* and 102*b*, and the feeding point 103.

A reflector 104 is placed at a position on the −Z side, leaving a distance h equivalent to 0.42 wavelength (25 mm) from the plane on which the diamond-shape antenna having delay elements is placed. The reflector 104 is a square conductor plate with a length of each side almost equivalent to one (60 mm) or more wavelength. In one of the methods for stabilizing the distance h by firmly fixing the diamond-shape antenna with delay elements and the reflector 104, for example, a resin spacer is used to mechanically support them. This method has less influence on antenna performance.

Figure 4A:
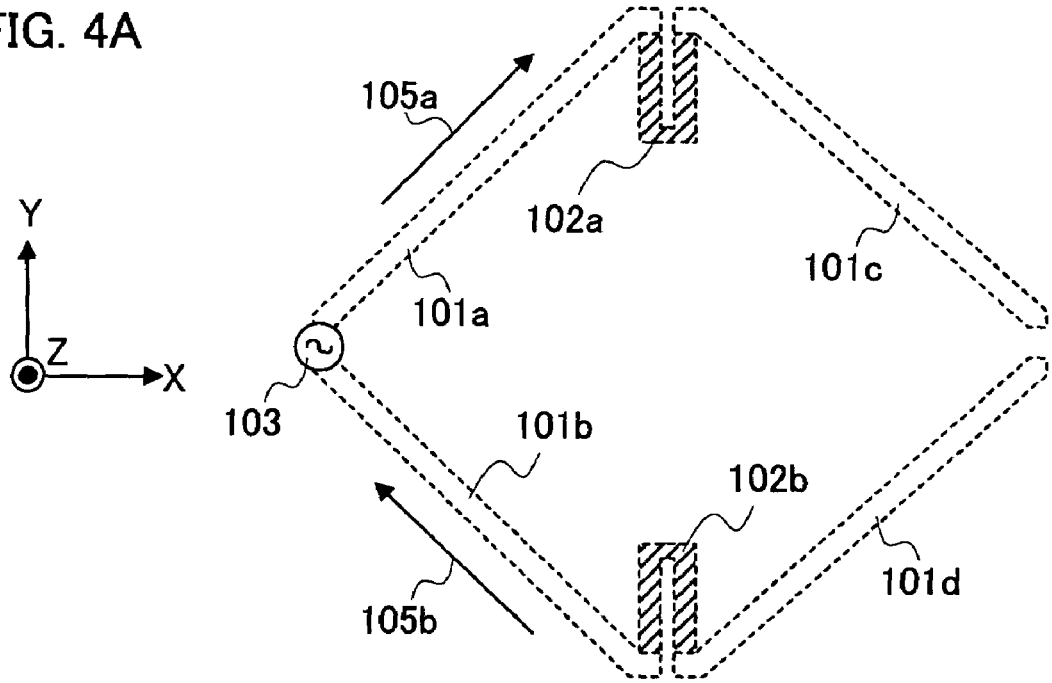
FIG. 4A is a schematic diagram showing the current distribution of the antenna device according to Embodiment 1 of the present invention.
Figure 4B:
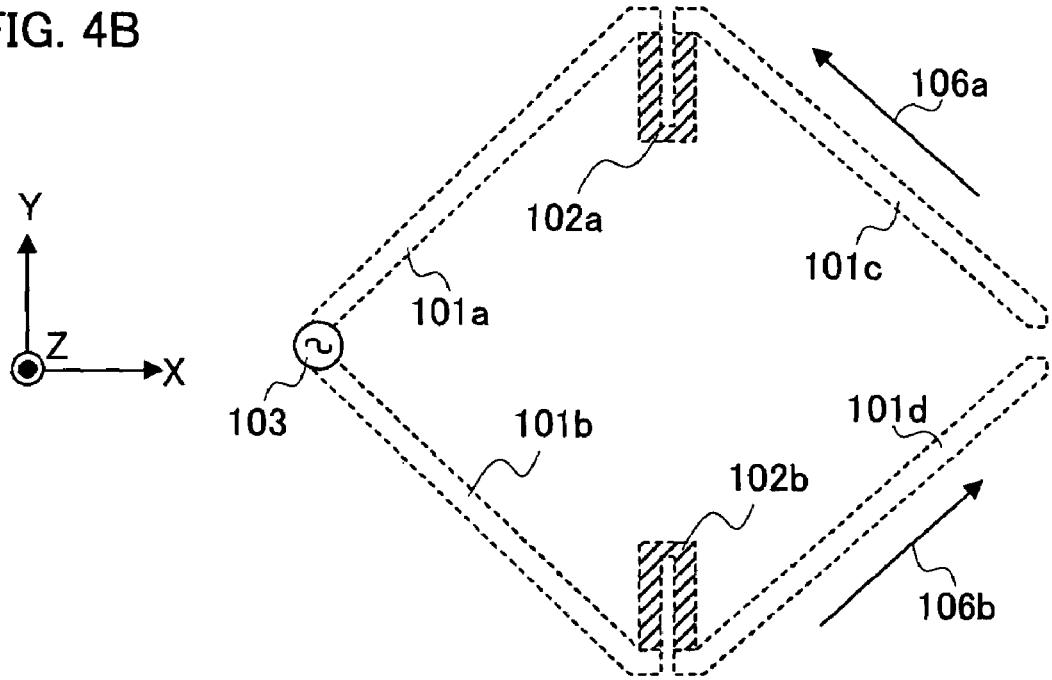
FIG. 4B is a schematic diagram showing the current distribution of the antenna device according to Embodiment 1 of the present invention.

Then, the operating principle of the antenna device having the aforementioned configuration is mentioned in reference to the accompanying drawings. FIGS. 4A and 4B are schematic diagrams showing the current distribution on an antenna device according to the embodiment 1 of the present invention.

In FIG. 4A, antenna currents flowing on the linear elements 101*a* and 101*b* are distributed as indicated by arrows 105*a* and 105*b*. The directions of the heads of these arrows suggest that the antenna currents flowing on the linear elements 101*a* and 101*b* are in phase. The antenna currents distributed on the linear elements 101*c* and 101*d* have values 0s (zero's) when 105*a* and 105*b* reach their maximum values because their phases are delayed by one fourth wavelength relative to those of 105*a* and 105*b* by means of the delay elements 102*a* and 102*b* as shown in FIG. 4. Assuming that two elements, the linear elements 101*a* and 101*b*, are paired, the antenna current may be considered to be a composed vector of arrows 105*a* and 105*b*, thereby the antenna behaves almost as a one-wavelength dipole polarized along the Y-axis.

Similarly, in FIG. 4B, the antenna currents flowing on the linear elements 101*c* and 101*d* are distributed as indicated by arrows 106*a* and 106*b*. The directions of the arrowheads suggest that the antenna currents are in phase. Assuming that two elements, the linear elements 101*c* and 101*d*, are paired, the antenna current may be considered to be a composed vector of arrows 106*a* and 106*b*, thereby the antenna may be regard as a one-wavelength dipole polarized along the Y-axis.

Figure 1:
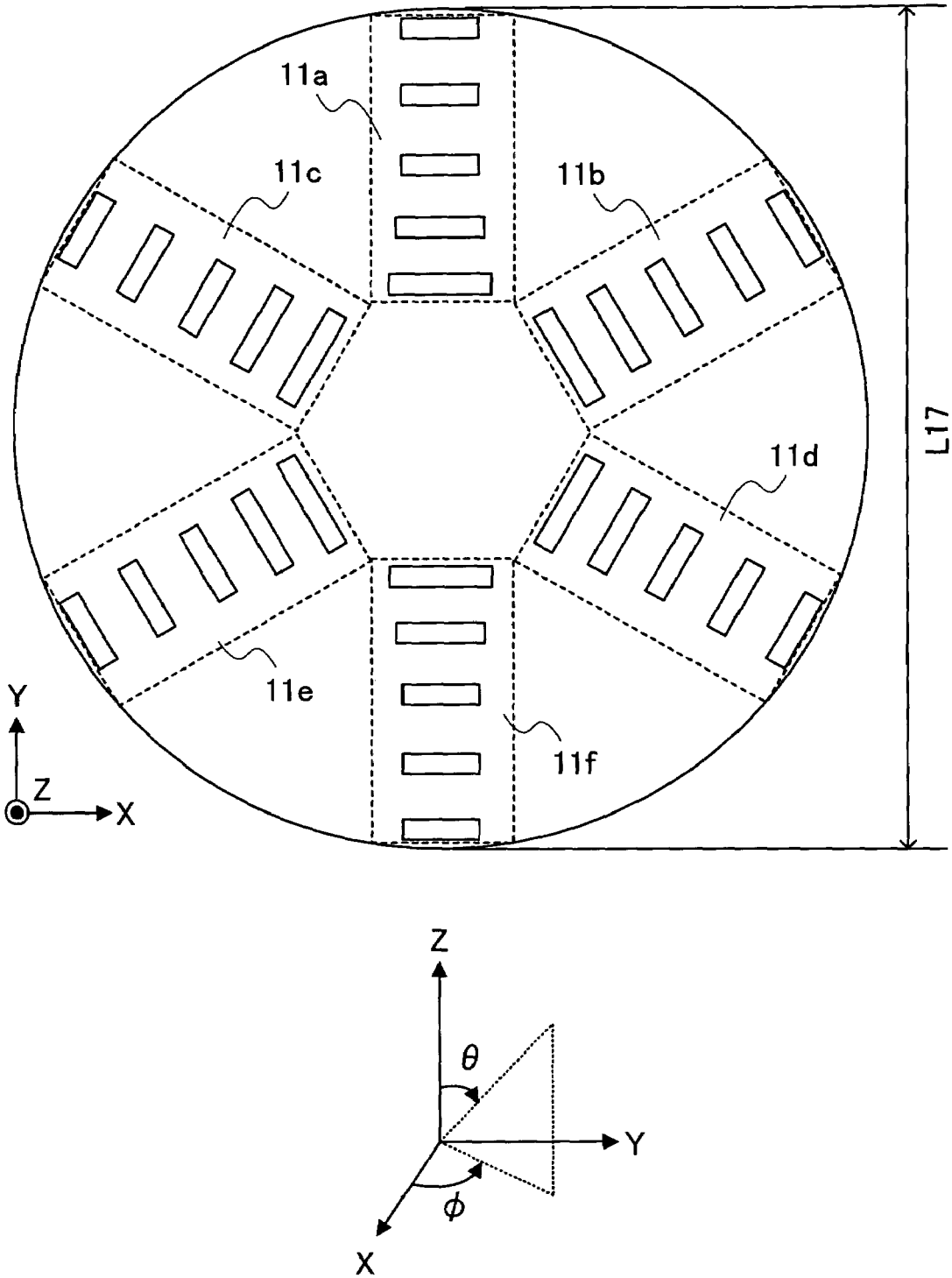
FIG. 1 is a view showing the configuration of a conventional sector antenna.
Figure 2:
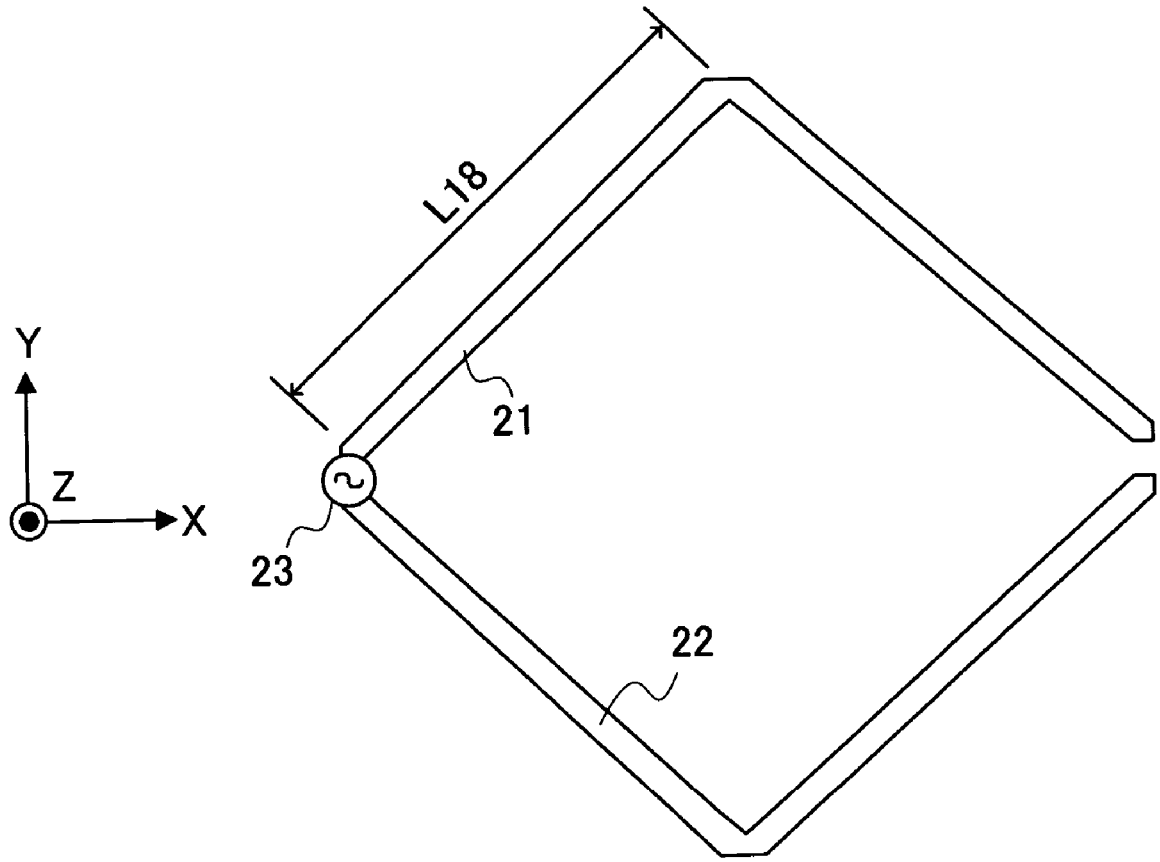
FIG. 2 is a view showing the configuration of a conventional diamond-shape antenna.

Assuming that no delay elements 102*a* and 102*b* have incorporated, and the linear elements 101*a* and 101*c* are connected one another while the linear elements 101*b* and 101*d* being connected one another, the primary beam advances along Z-axis and the primary polarized wave is related to the Y-axis. This is the operating principle of the conventional diamond-shape antenna shown in FIG. 2.

Then, focusing on a vertical X-Z plane, the operating principle of the antenna device, of which delay elements 101*a* and 101*b* are connected one another, shown in FIG. 3 is mentioned.

Figure 5:
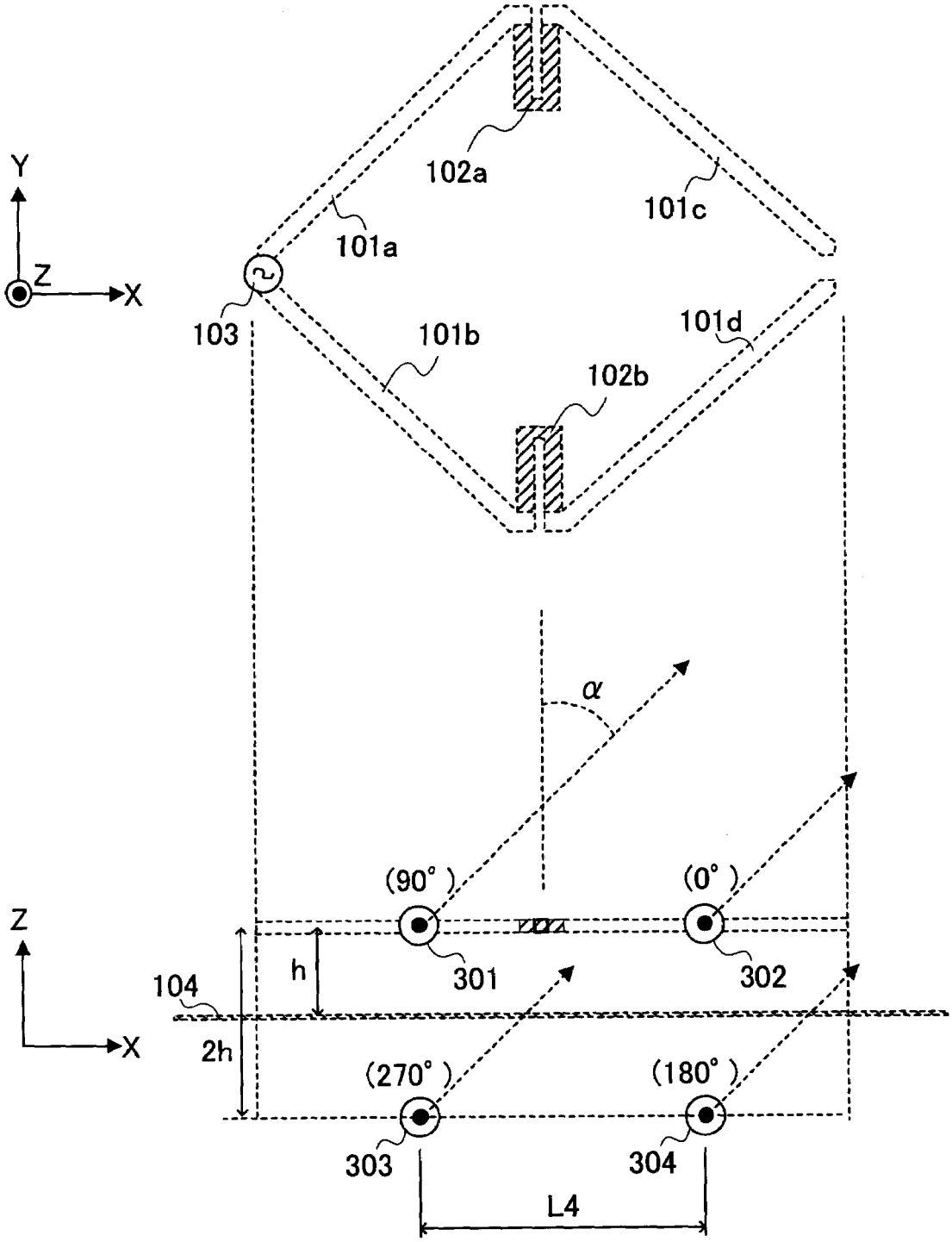
FIG. 5 is a pattern diagram explaining the operating principle of the antenna device according to the embodiment 1 of the present invention using a point source model.

One of models focusing exclusively on the vertical X-Y plane is a point source model shown in FIG. 5. FIG. 5 is a pattern view explaining the operation of the antenna according to the embodiment 1 of the present invention using the point source model. A pair of linear elements 101*a* and 101*b* is modeled as the point source 301, while a pair of 101*c* and 101*d* is modeled as a point source 302. Since the element length of each of the delay elements 102*a* and 102*b* is equivalent to one fourth wavelength, the excitation phase at the point source 301 advances from that at the point source 302 by 90°.

It is assumed that the point sources 303 and 304 are placed at a distance 2 h (0.84 wavelength: 50 mm) from the point sources 301 and 302 to model the effect of the reflector 104. Based on the principle of transformation, the excitation phases of the point sources 303 and 304 may reverse their courses by 180° relative to those of the point sources 301 and 302.

Since the position of each point source along the X-axis is assumed to be the center of each linear element, the interval L4 between the point sources along the X-axis is equivalent to 0.71 wavelength (42.4 mm).

With four point sources 301 to 304 placed in this way, the array radiates the primary beam advancing toward the direction tilting from the Z-axis at an angle $\alpha$ (45°) The insertion of the reflector 104, in particular, may provide an effective tilt angle according to the embodiment 1 of the present invention.

Figure 6A:
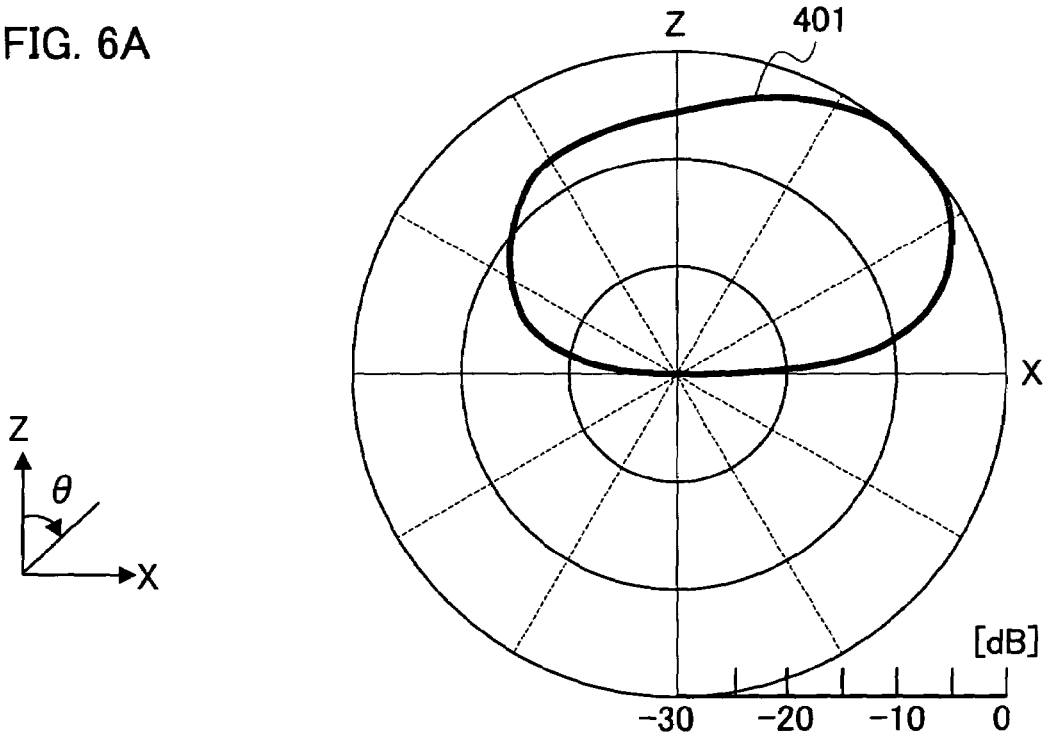
FIG. 6A is a view showing the directivity of the antenna device according to Embodiment 1 of the present invention.
Figure 6B:
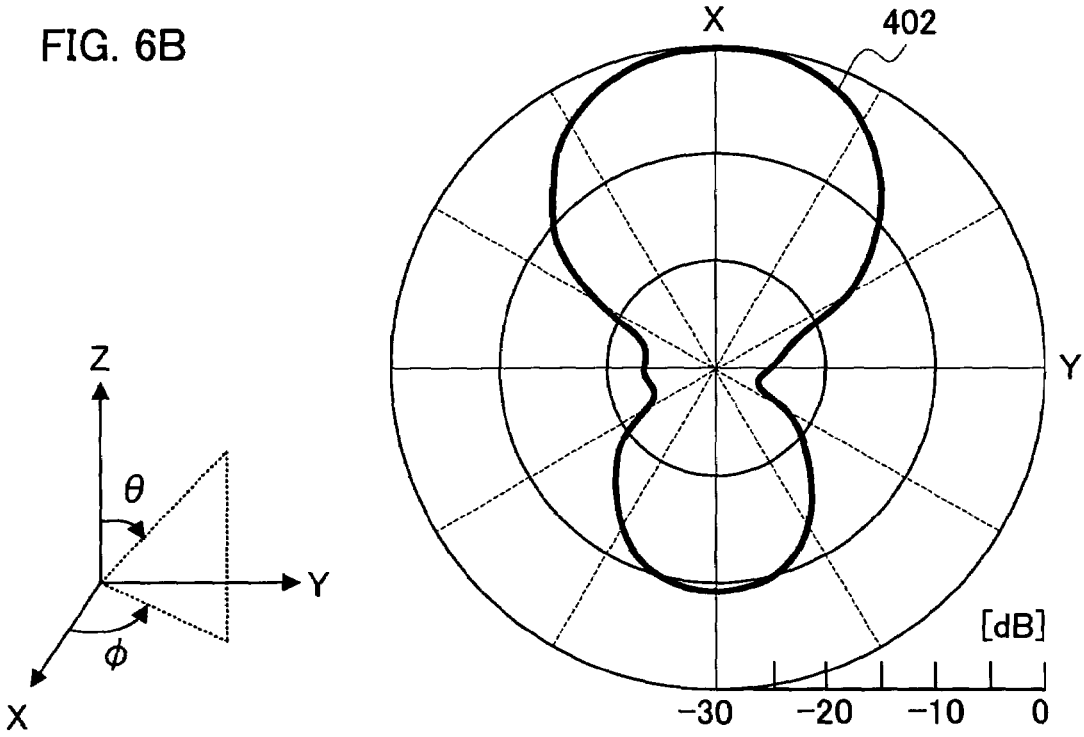
FIG. 6B is a view showing the directivity of the antenna device according to Embodiment 1 of the present invention.

FIGS. 6A and 6B are the views showing the directivity of the antenna device according to the embodiment 1 of the present invention. In FIG. 6A, a directivity 401 indicates the directivity of a horizontally-polarized wave ($E\phi$) component on a vertical (X-Y) plane. As known from this figure, the primary beam advances toward the direction, in which $\theta$ tilts at an angle of 45°.

In FIG. 6B, a directivity 402 indicates the directivity of horizontally-polarized wave ($E\phi$) component on a conical surface, of which $\theta$ is 45°. As know from this figure, the primary beam advances along the X-axis and the half-width of the horizontal plane (a gain is an angle within −3 [dB] relative to its maximum gain) is 60°. In this case, the directivity of the primary beam may achieve a gain of 9.9 [dB].

As aforementioned, according to the antenna device according to the embodiment 1 of the present invention, by placing the linear elements with a length equivalent to half a wavelength so that they may draw a diamond shape and incorporating the delay elements at the opposite apex pairs, the antenna device suitably mounted on a small wireless apparatus may be achieved and further, the primary beam of which horizontally-polarized wave has a tilt angle of 45°, may be formed.

Note that in the embodiment 1, which has been mentioned assuming that the distance h from the linear elements to the reflector is equivalent to 0.42 wavelength, by changing the distance h, the tilt angle $\alpha$ may be varied. As the distance h is decreased, the tilt angle narrows and as it being increased, the tilt angle augments. Note that an increase in distance h may cause an unwanted maximum point (minor lobe) of directivity to occur along the −X-axis. For this reason, by selecting the distance h from a range of values from one fourth wavelength to half a wavelength depending on the application of the antenna, the gain of the antenna may be improved. In the embodiment 1, h has been set to 0.42 wavelength, achieving the optimal tilt angle and directivity.

In addition, in the embodiment 1, which has been mentioned assuming that the length of delay elements is equivalent to one fourth wavelength, by changing the length of the delay elements, the tilt angle a may be varied. As the length of the delay elements is decreased, the tilt angle narrows and as the length being increased, the tilt angle widens. Note that an increase in length of the delay elements may cause a minor lobe of directivity to occur along the −X-axis. For this reason, by selecting the length of the delay elements of the antenna from a range of values from 0.2 to 0.35 wavelength depending on the application of the antenna, the gain of the antenna may be improved. In the embodiment 1, the length of the delay elements is set to one fourth wavelength, achieving the optimal tilt angle and directivity.

Furthermore, in the embodiment 1, conductor type of delay lines are used, though the use of lumped constant parts, for example, inductors, may have the same effects as those aforementioned.

It goes without saying that although the linear elements, which have been placed so that they may draw a diamond shape, have been mentioned so far, the elements may be placed so that they may draw a square.

Moreover, in the embodiment 1, which has been mentioned using four linear elements, according to the present invention, two linear elements are bent to form linear delay elements, enabling the diamond-shape with delay elements to be achieved. This may not only have a less number of parts compared with the antenna composed of four linear elements but also make easy the process of manufacturing antennas.

EMBODIMENT 2

Figure 7:
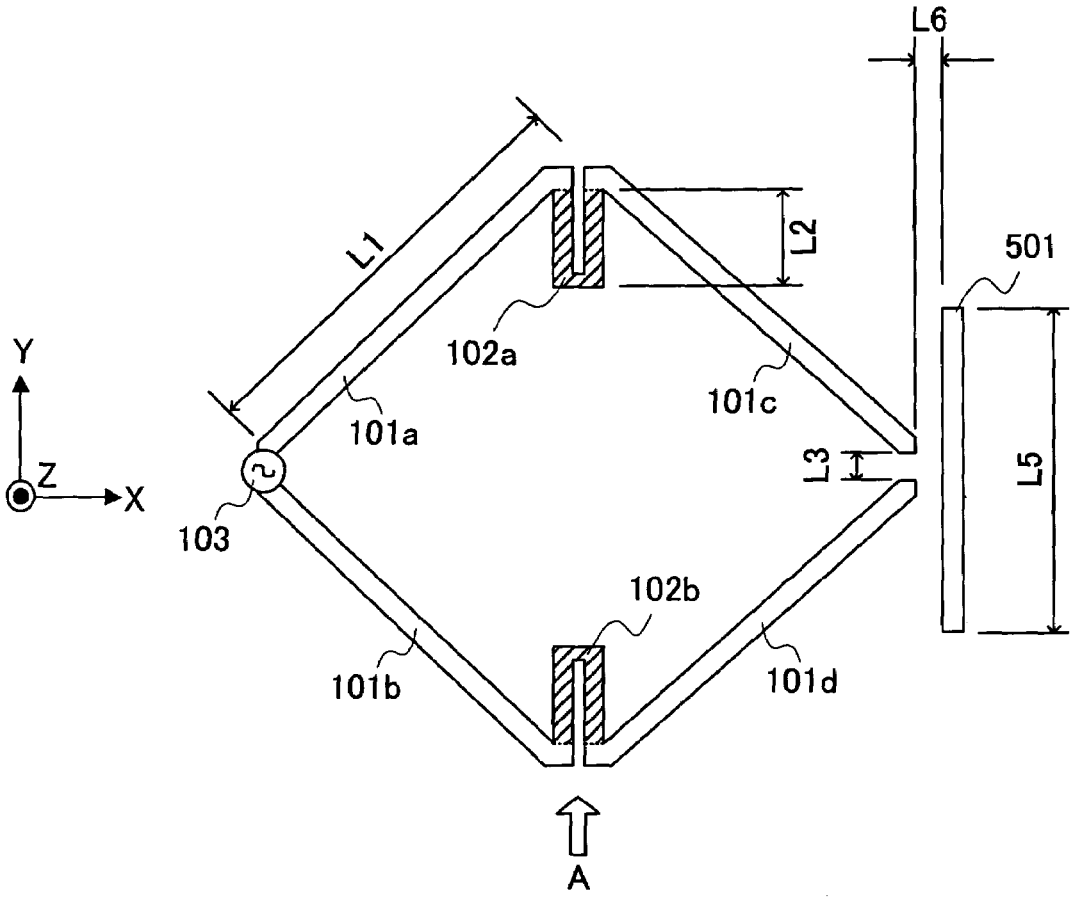
FIG. 7 is a view showing the configuration of an antenna device according to Embodiment 2 of the present invention.
Figure 7:
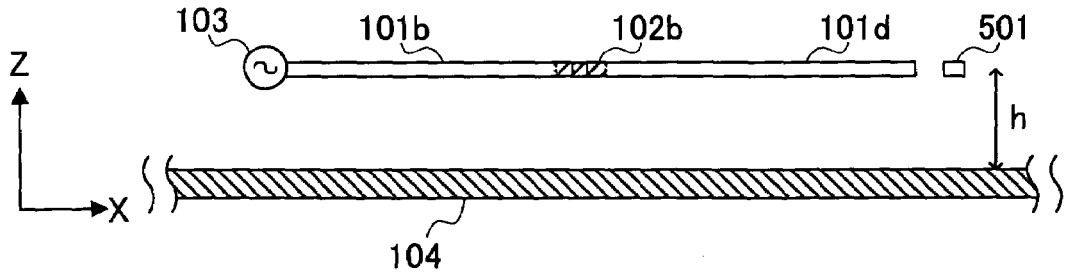

FIG. 7 is a view showing the configuration of an antenna device according to the embodiment 2 of the present invention. Note that the same portions in FIG. 7 as those in FIG. 3 have the symbols identical to those in FIG. 3 to omit their detailed descriptions. Only one difference between FIGS. 3 and 7 is in that a director element 501 has been added in the latter. The embodiment 2 is mentioned below assuming that the operating frequency of the antenna is 5 GHz.

In FIG. 7, the director element 501 is a conductor having a length L5 equivalent to 0.46 wavelength (27.6 mm) and a element width of 1 mm. The direct or element 501 is placed at a distance L6 (1 mm) from the tips of the linear elements 101*c* are 101*d* along the X-axis.

Figure 8A:
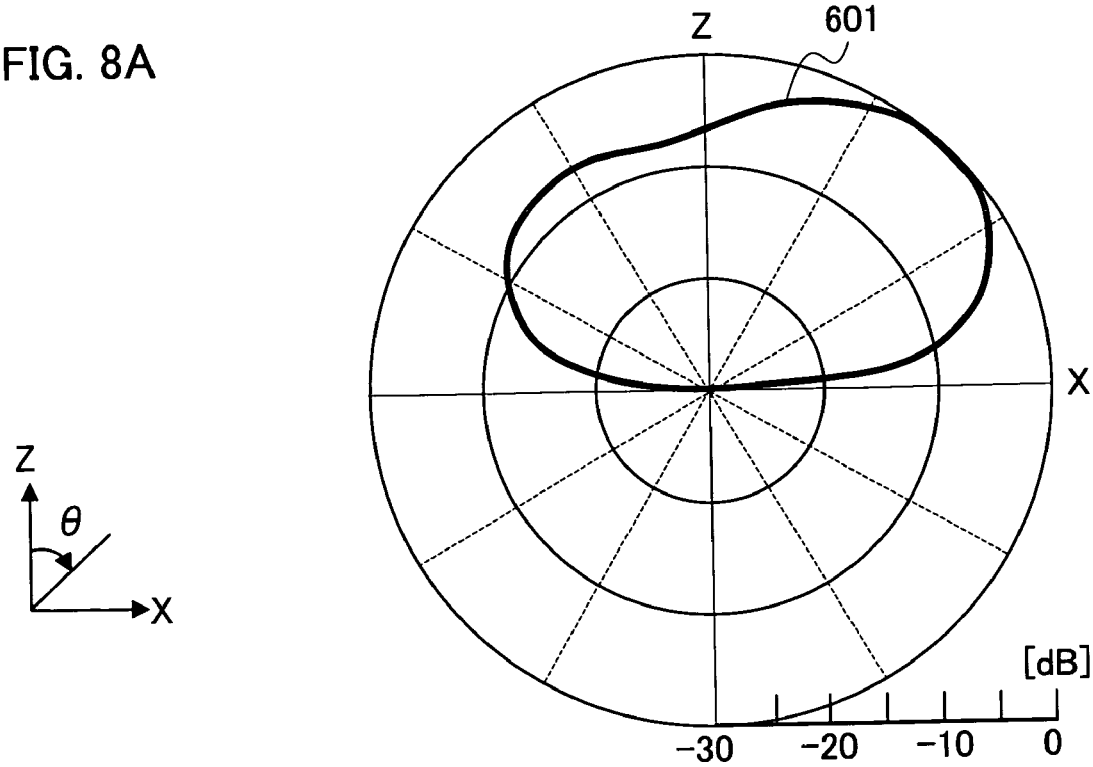
FIG. 8A is a view showing the directivity of the antenna device according to Embodiment 2 of the present invention.
Figure 8B:
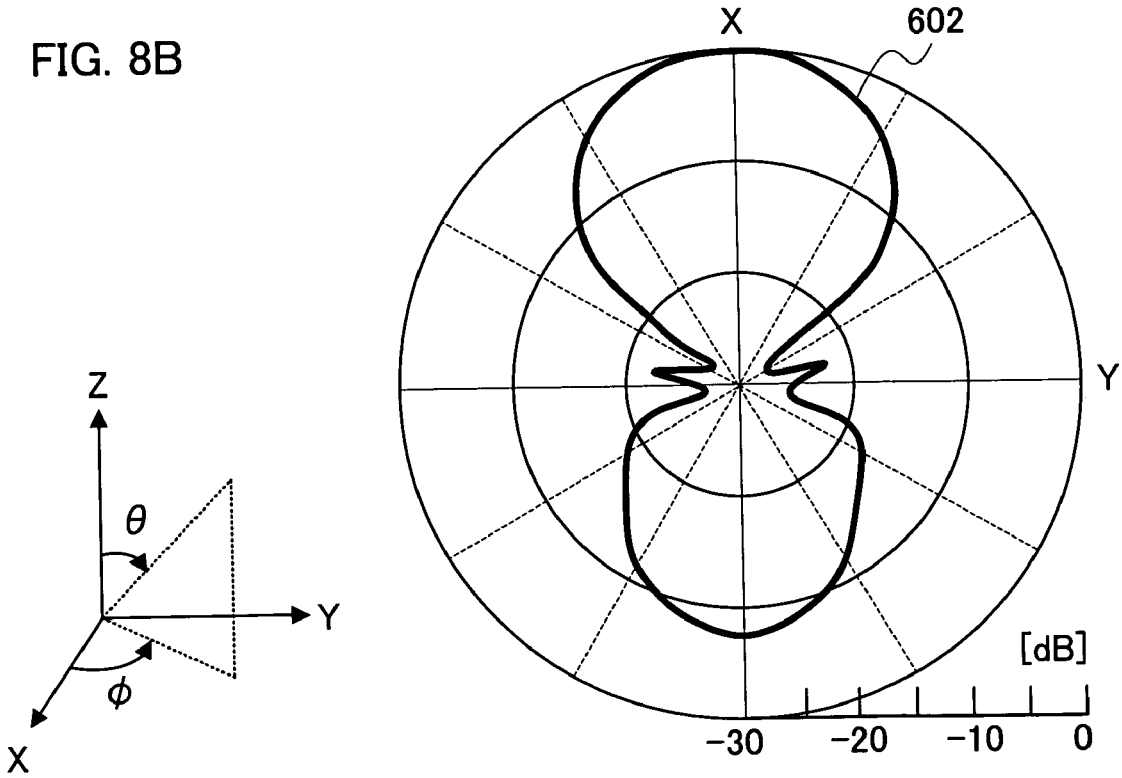
FIG. 8B is a view showing the directivity of the antenna device according to Embodiment 2 of the present invention.

FIGS. 8A and 8B are views showing the directivity of the antenna device according to the embodiment 2 of the present invention. In FIG. 8A, a directivity 601 indicates the directivity of the horizontally-polarized wave (Eϕ) component on the vertical (X-Z) plane. As known from this figure, θ of the primary beam tilts at an angle of 45°. In FIG. 8B, the directivity 602 indicates the directivity of the horizontally-polarized wave (Eϕ) component on the conical surface, of which θ is 45°. In this case, the directivity of the primary beam achieves a gain of 11.2 [dB]. In this way, the incorporation of the director element 501 may converge a radiated beam along the X-axis, improving the gain of the diamond-shape antenna with delay elements along the X-axis. This means that simply by enlarging the dimension of the antenna device mentioned in the description of the embodiment 1 by only 2 mm, a 1.3 [dB] higher gain may be achieved.

Thus, according to the antenna device according to the embodiment 2 of the present invention, the addition of the director element to the antenna device mentioned in the description of the embodiment 1 may improve the gain in the direction of the director element.

Note that the distance L6 between the director element 501 and the linear elements 101*c* or 101*d*, and the length of the director length L5 are given as only examples. By modifying these parameters to change both the directivity and gain of the antenna device, appropriate parameters may be selected depending on the application of the antenna.

Two or more director elements instead of only one element may be incorporated in a row along the X-axis to achieve a further higher gain.

EMBODIMENT 3

In the embodiment 3, an antenna device, in which the linear elements of the antenna device mentioned in the embodiment 1 have been replaced with slot (gap) elements.

Figure 9:
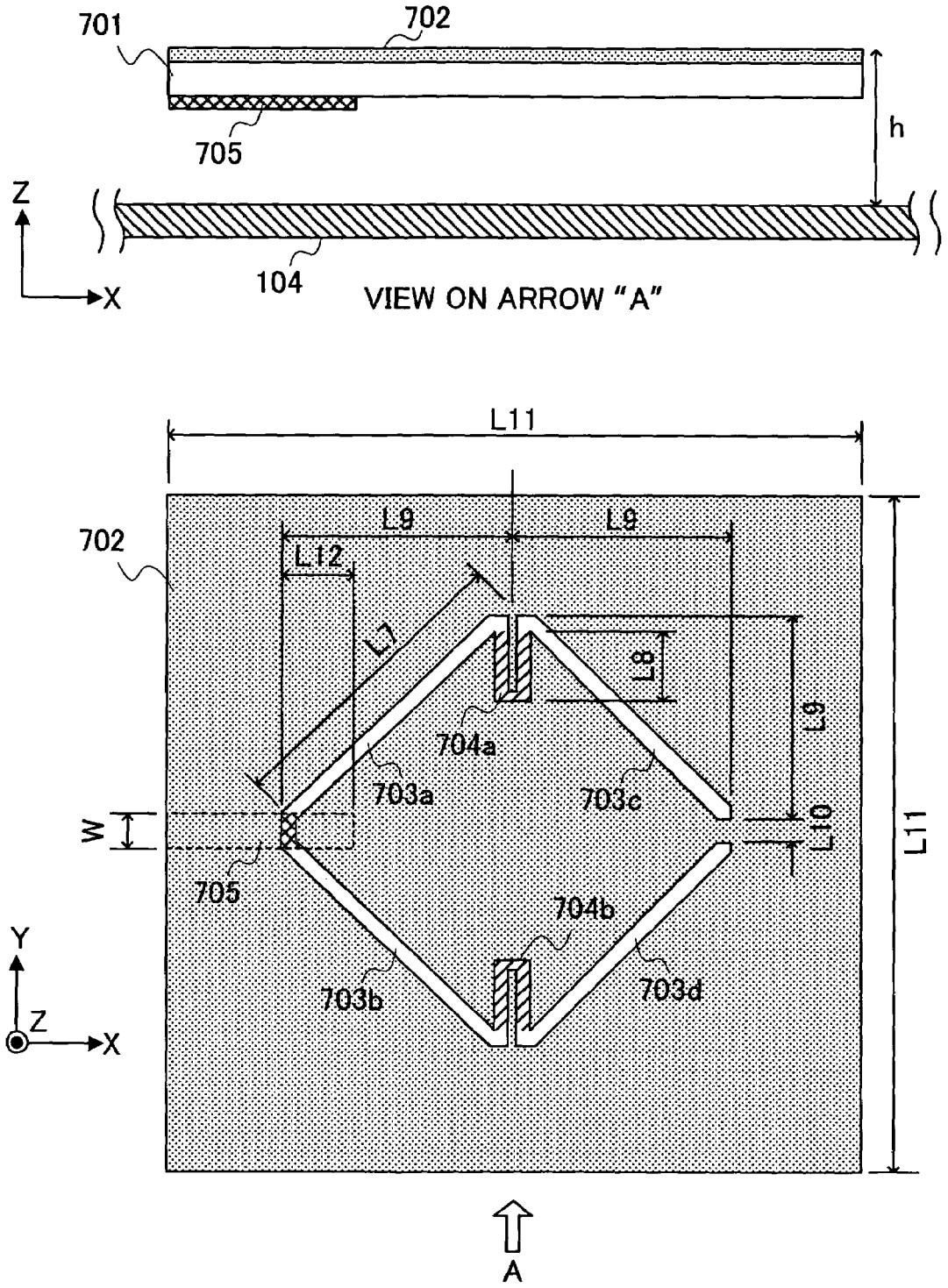
FIG. 9 is a view showing the configuration of an antenna device according to Embodiment 3 of the present invention.

FIG. 9 is a view showing the configuration of the antenna device according to the embodiment 3 of the present invention. Note that the same portions in FIG. 9 as those in FIG. 3 have the symbols identical to those in FIG. 3 to omit their detailed descriptions. The embodiment 3 is mentioned below assuming that the operating frequency of antenna is 5 GHz.

In FIG. 9, a substrate 701 is a dielectric with a dielectric constant $\epsilon r$ of, for example, 2.6 and a thickness of 1.6 mm, wherein the effective wavelength ($\lambda_e$) on the substrate 701 is equivalent to 84% of the wavelength ($\lambda_0$) in a free space. This means that a relationship may be established between both the wavelengths; $\lambda_e=0.84\lambda_0$. For this reason, the effective wavelength ($\lambda_e$) is used to explain the embodiment 3 below. The length L11 of each side of the substrate 16 is equivalent to $1.107\lambda_e$ (56 mm).

A copper foil layer 702 indicates the copper foil adhered to the side Z of the substrate 701. Slot elements 703*a* to 703*d* are the slot elements, which have been formed by denuding the cupper foil layer 702. Slot delay elements 704*a* and 704*b* are also formed by denuding the cupper foil layer 702. The length L7 of each of the slot elements 703*a* to 703*d* is set to $\frac{1}{2}\lambda_e$ (25 mm). The element length of each of the delay elements 704*a* and 704*b* is ¼$\lambda_e$ (12.6 mm) and the length L8 of each of their longitudinal sides is set to ⅛$\lambda_e$ (6.3 mm).

A gap L10 with the cupper foil layer left, which is defined between the tips of the slot elements 703*c* and 703*d*, is 2 mm. A slot (gap) is connected to the elements 703*a* and 703*b*.

A slot diamond-shape antenna with delay elements having a length L9 equivalent to 0.702$\lambda_e$ (35.4 mm) is composed of the slot elements 703*a* to 703*d* and the slot delay elements 704*a* and 704*b* formed in the aforementioned way.

A micro strip line 705 is formed using the copper foil layer along the X-axis in the vicinity of the connection between the slot elements 703*a* and 703*b* on the −Z side on the substrate 701. The width W of the micro strip line 705 is 4.3 mm and its characteristic impedance is set to 50Ω. The distance L12 between the tip of the micro strip line 705 and the connection between the slot elements 703*a* and 703*b* is set to, for example, 4.5 mm.

This configuration enables the micro strip line 705 and the slot diamond-shape antenna with delay elements are electromagnetically coupled to one another, allowing the micro strip line 705 to operate as a feeding line. This makes it possible to feed power with impedances balanced, resulting in easy power feed to the dielectric substrate from the micro strip line, a plane circuit. Thus, the antenna device may be further miniaturized.

In the diamond-shape antenna with delay elements according the embodiment 3 shown in FIG. 9, the linear elements of the diamond-shape antenna with delay elements shown in FIG. 3 have been replaced with the slot elements. The operating principle of the antenna may be explained with an electric field replaced with a magnetic field. Thus, the primary polarized wave component of the slot diamond-shape antenna with delay elements shown in FIG. 3 is a horizontal component while that shown in FIG. 9 is vertical component (Eθ).

Figure 10A:
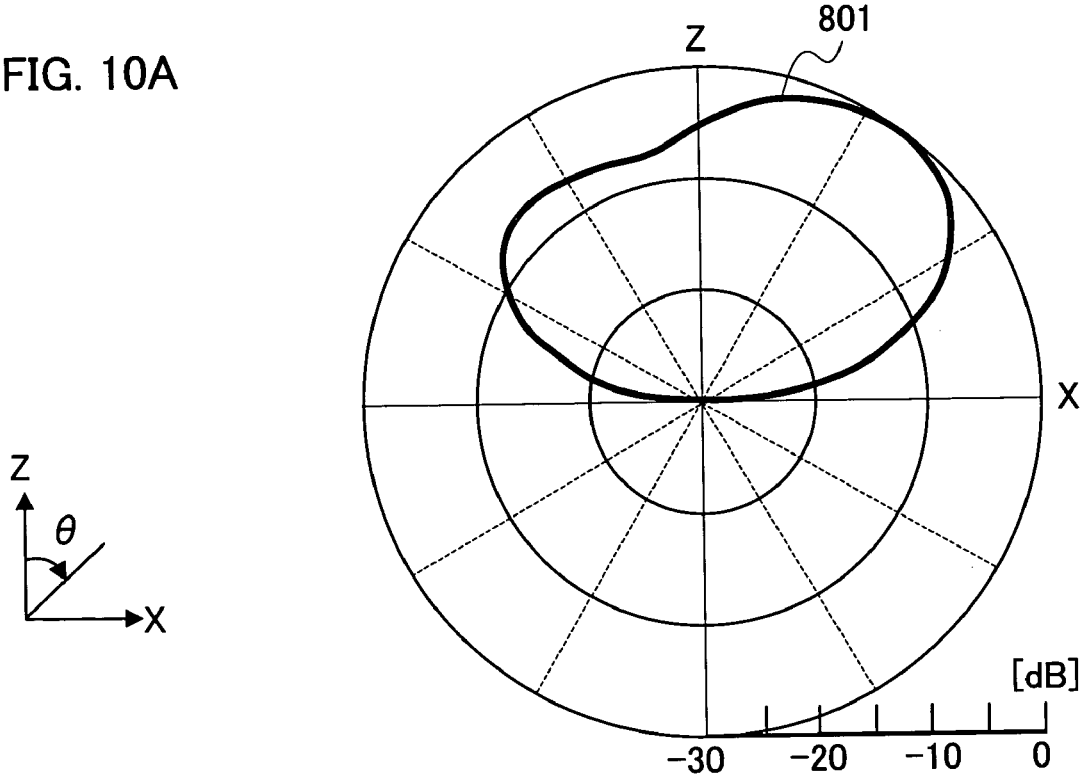
FIG. 10A is a view showing the directivity of the antenna device according to Embodiment 3 of the present invention.
Figure 10B:
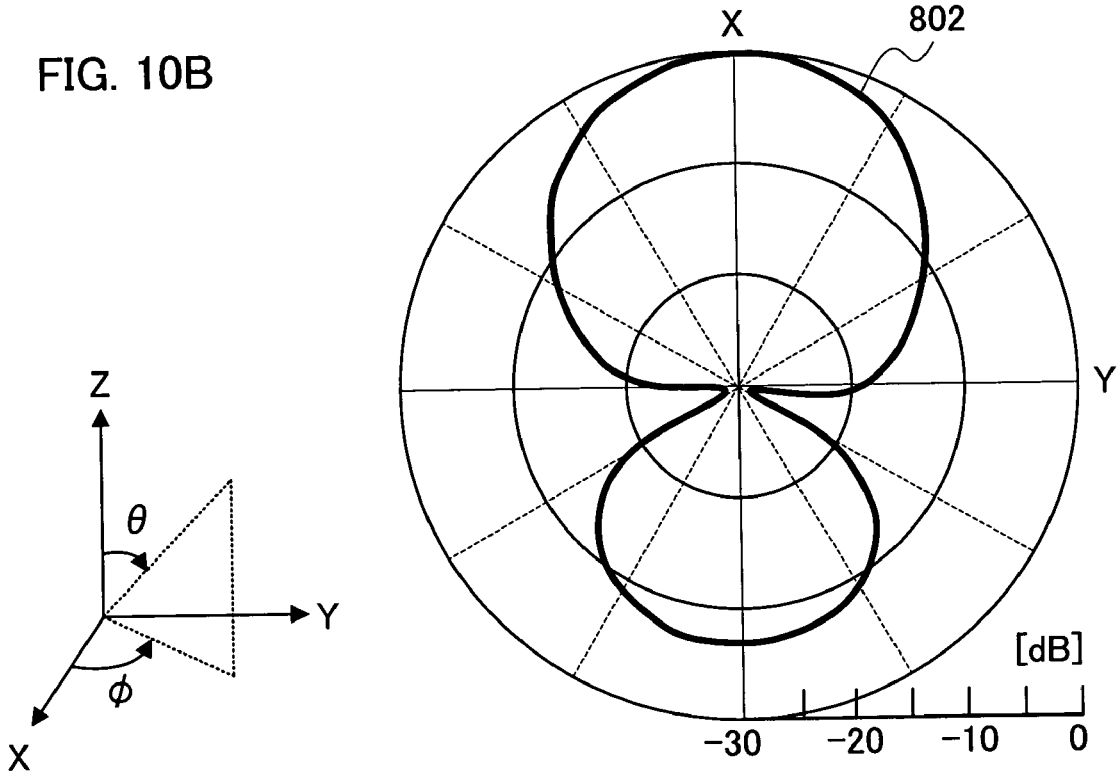
FIG. 10B is a view showing the directivity of the antenna device according to Embodiment 3 of the present invention.

FIGS. 10A and 10B are views showing the directivity of the antenna device according to the embodiment 3 of the present invention. In FIG. 10A, a directivity 801 indicates the directivity of the vertically-polarized wave (Eθ) component on the vertical (X-Z) plane. As known from this figure, θ of the primary beam tilts at an angle of 35°.

In FIG. 10B, a directivity 802 indicates the directivity of the vertically-polarized wave (Eθ) component on the conical surface, of which θ is 35°. This means that the primary beam advances along the X-axis. It also may be confirmed that the half-width of the horizontal plane is 60°. The directivity of the primary beam may achieve a gain of 10.6 [dB].

Thus, according to the antenna device according to the embodiment 3, not only the antenna device, which may be suitably mounted on a small wireless apparatus, may be provided but also the tilt angle of 35° may be used and the vertical polarized wave (Eθ) component is used as the primary polarized wave component by placing the slot elements with a length equivalent to half a width so that they may draw a diamond shape and incorporating the delay slot elements at the opposite apex pairs to make the plane smaller.

Note that although in the embodiment 3, the slot elements have been formed using the copper foil layer on the dielectric substrate, almost the same effect may be achieved, for example, by forming the slots (gaps) on the conductor plate.

EMBODIMENT 4

Figure 11:
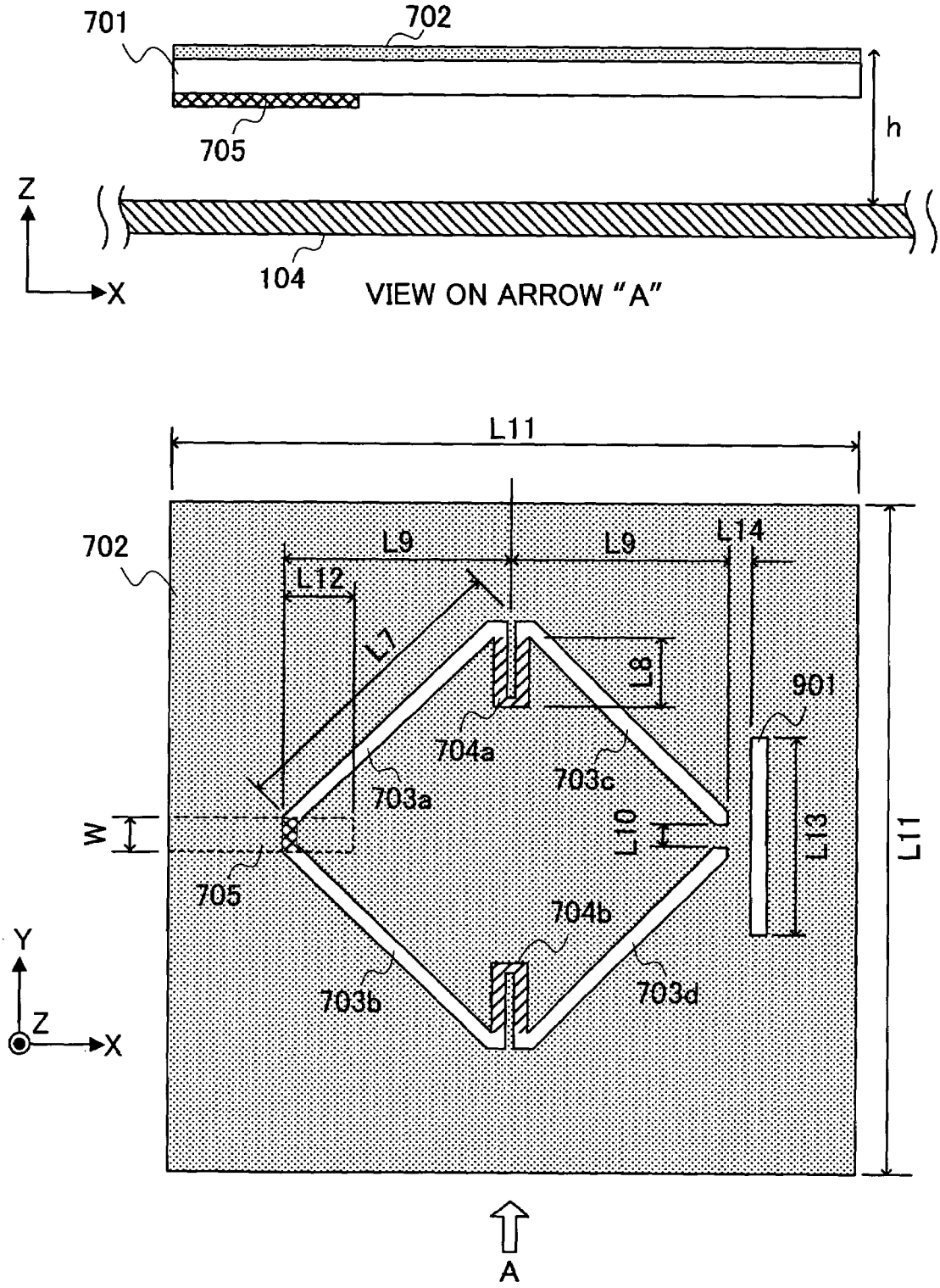
FIG. 11 is a view showing the configuration of an antenna device according to Embodiment 4 of the present invention.

FIG. 11 is a view showing the configuration of an antenna device according to the embodiment 4 of the present invention. Note that the same portions in FIG. 11 as those in FIG. 9 have the symbols identical to those in FIG. 9 to omit their detailed descriptions. Only one difference between FIGS. 9 and 11 is in that a director slot element 901 has been added in the latter. The embodiment 4 is explained below assuming that the operating frequency of the antenna is 5 GHz.

In FIG. 11, the director slot element 901 is the slot with a length L13 equivalent to 0.4$\lambda_e$ (20.4 mm) and an element width of 1 mm. The director slot element 901 is placed at a L14 (2 mm) distance from the tips of the slot elements 703*c* and 703*d* along the X-axis in parallel to the Y-axis. Note that $\lambda_e$ is assumed to be 0.84λ.

Thus, since the formation of the director slot element 901 enables the beam radiated from the slot diamond-shape antenna with delay elements to converge along the X-axis, improving the ratio (F/B ratio) between the gains along the X and −X axes.

Figure 12A:
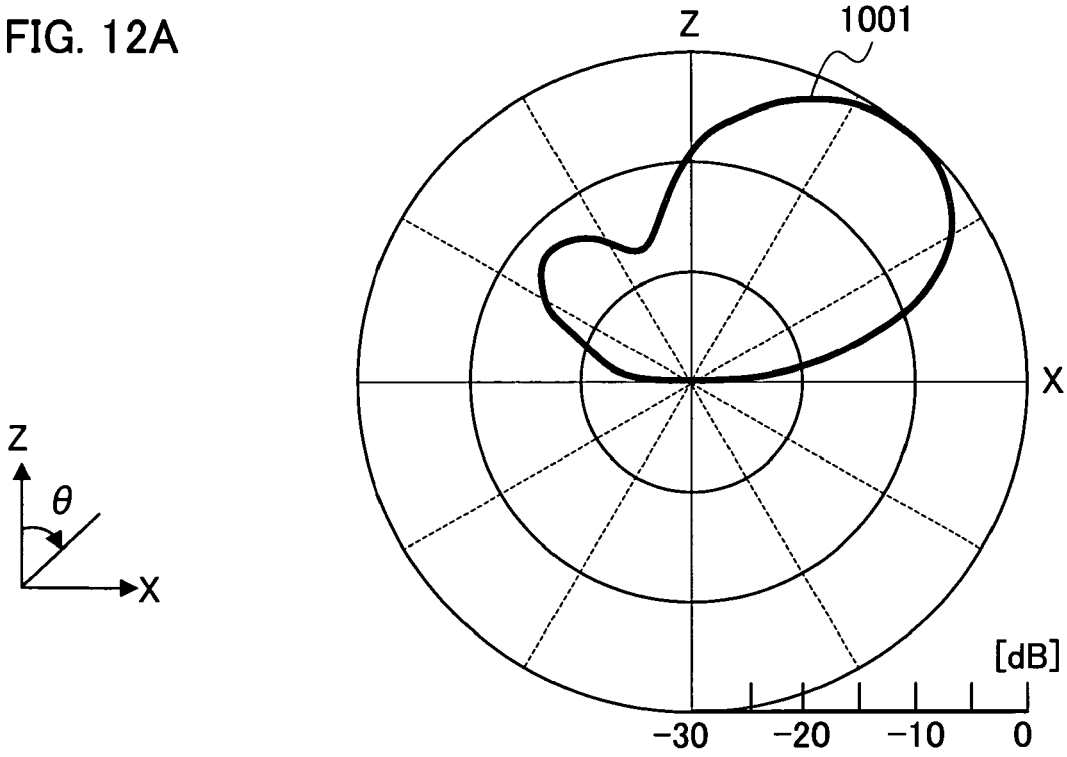
FIG. 12A is a view showing the directivity of the antenna device according to Embodiment 4 of the present invention.
Figure 12B:
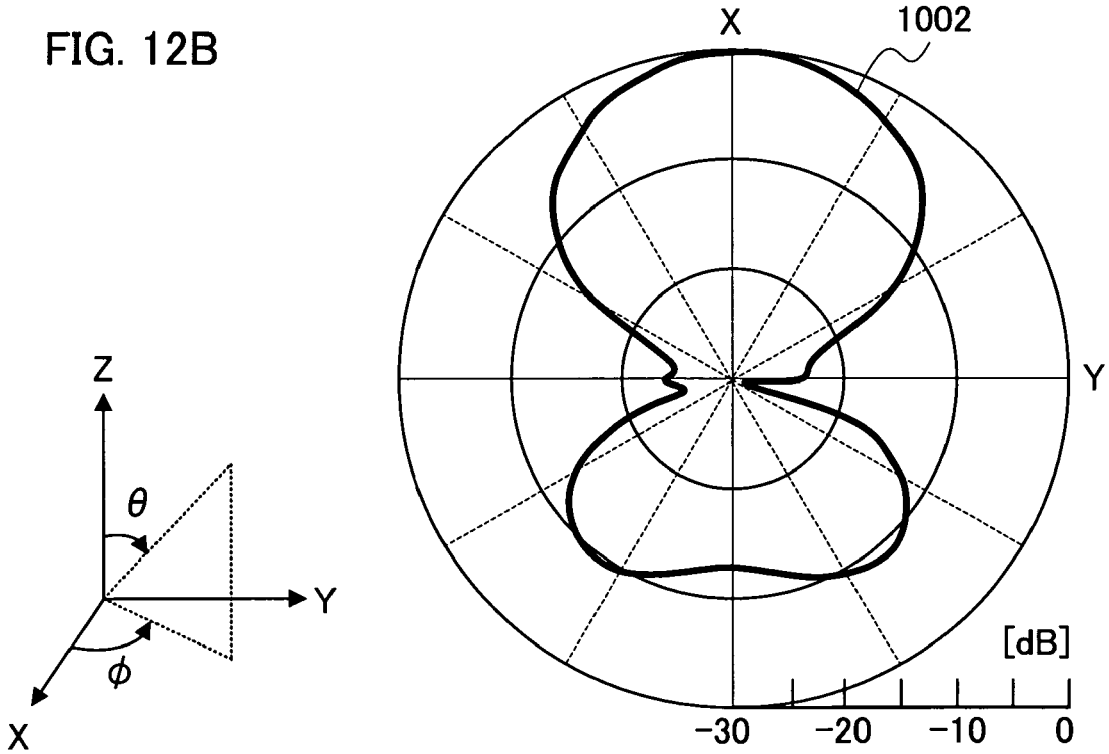
FIG. 12B is a view showing the directivity of the antenna device according to Embodiment 4 of the present invention.

FIGS. 12A and 12B are views showing the directivity of the antenna device of according to the embodiment 4 of the present invention. In FIG. 12A, the directivity 1001 indicates the directivity of the vertically-polarizes wave (Eθ) component on the vertical (XZ) plane. From this figure, the primary beam, of which θ tilts at an angle of 45° may be recognized. In FIG. 12B, the directivity 1002 indicates the directivity of the vertically-polarizes wave (Eθ) component on the conical surface at an angle of 45°.

As known from FIG. 12, the formation of the director slot element 901 enables the tilt angle to be enlarged up to 40° and the F/B ratio of 12 [dB] to be achieved.

Thus, according to the antenna device according to the embodiment of the present invention, the formation of the director slot element on the antenna device mentioned in the embodiment 3 enables the tilt angle to be enlarged and higher F/B ratio to be achieved.

Note that the distance L14 between the director slot element 901 and the slot elements 703*c* and 703*d*, as well as the length L13 of the director slot element 901, are just examples taken in describing this embodiment. It is preferable to select appropriate parameters according to individual applications because the directivity and gain of the antenna may change as these parameters are modified.

In addition, more than one director slot element(s) may be used. Rather, two or more of the director slot elements aligned in line along the X axis would offer further higher F/B ratio.

EMBODIMENT 5

Figure 13:
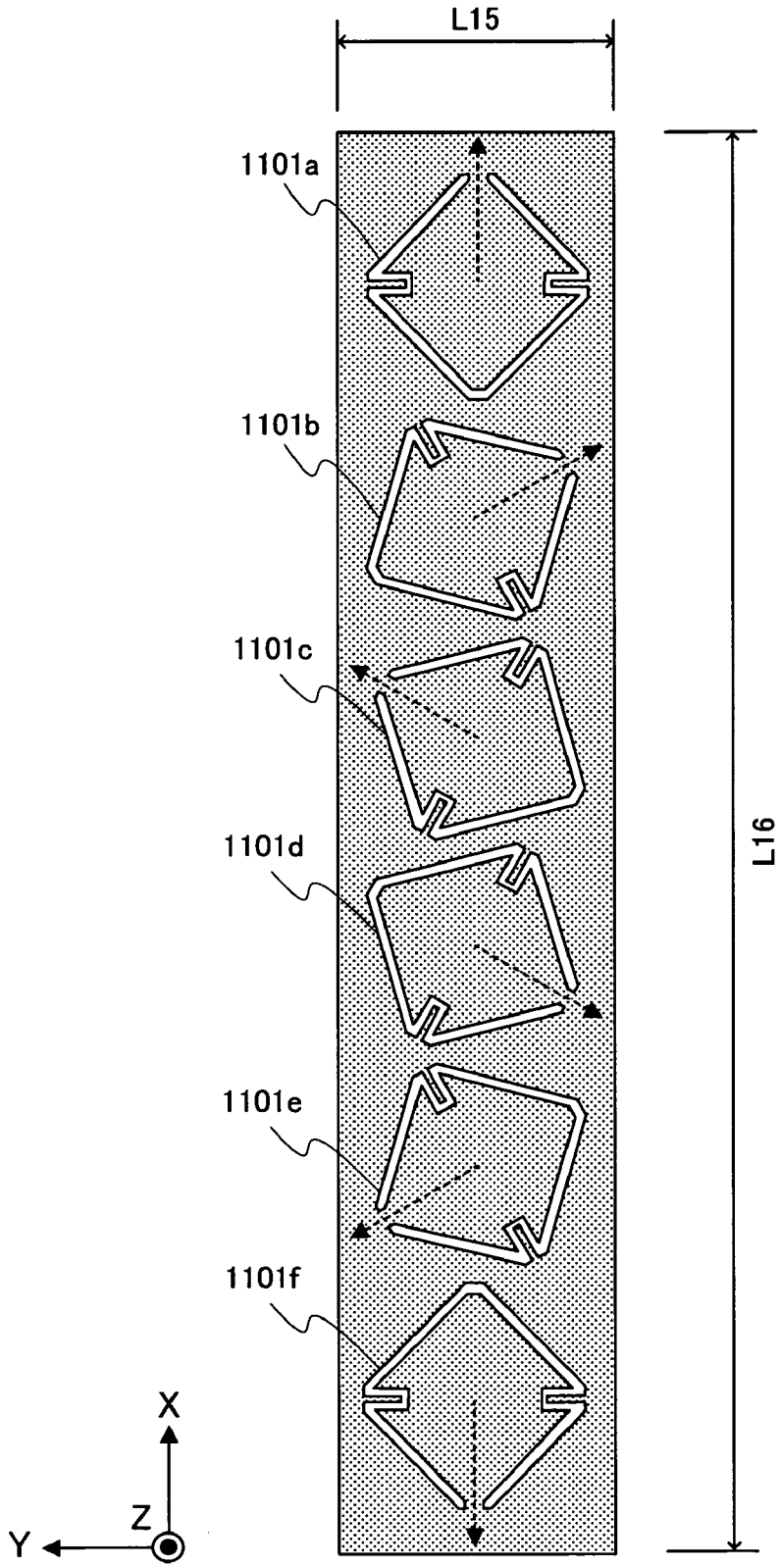
FIG. 13 is a view showing the configuration of an antenna device according to Embodiment 5 of the present invention.

FIG. 13 is a view showing the configuration of an antenna device according to an embodiment 5 of the present invention. The antenna device shown in this figure has six slot diamond-shape antennas with delay elements linearly placed shown in FIG. 9.

In FIG. 13, each of the slot diamond-shape antennas with delay elements 1101*a* to 1101*f* has the same configurationas that of the antenna device shown in FIG. 9. The antennas 1101*a* to 1101*f* are placed while being rotated so that their primary beams (indicated by arrows in the figure) may divide 360° into six sectors on the horizontal plane and may be shifted by 60° each other.

The outer dimension of the six-sector antenna shown in FIG. 13 is L15 of 36.3 mm (0.61 wavelength), L16 of 218.4 mm (3.64 wavelength), and an area of 7993 $mm^2$. This area is equivalent to one forth of the area (30790 $mm_2$) of conventional six-sector antenna, indicating that the size of the antenna has been significantly reduced.

In the case where the operating frequency of the antenna is 25 GHz, the shape of the six-sector antenna shown in FIG. 13 is rectangular (7.3 mm×43.7 mm), namely the shape and size of the six-sector antenna shown in FIG. 13 allows the antenna to be suitably mounted on any of small wireless apparatuses, for example, a notebook-PC type.

Figure 14:
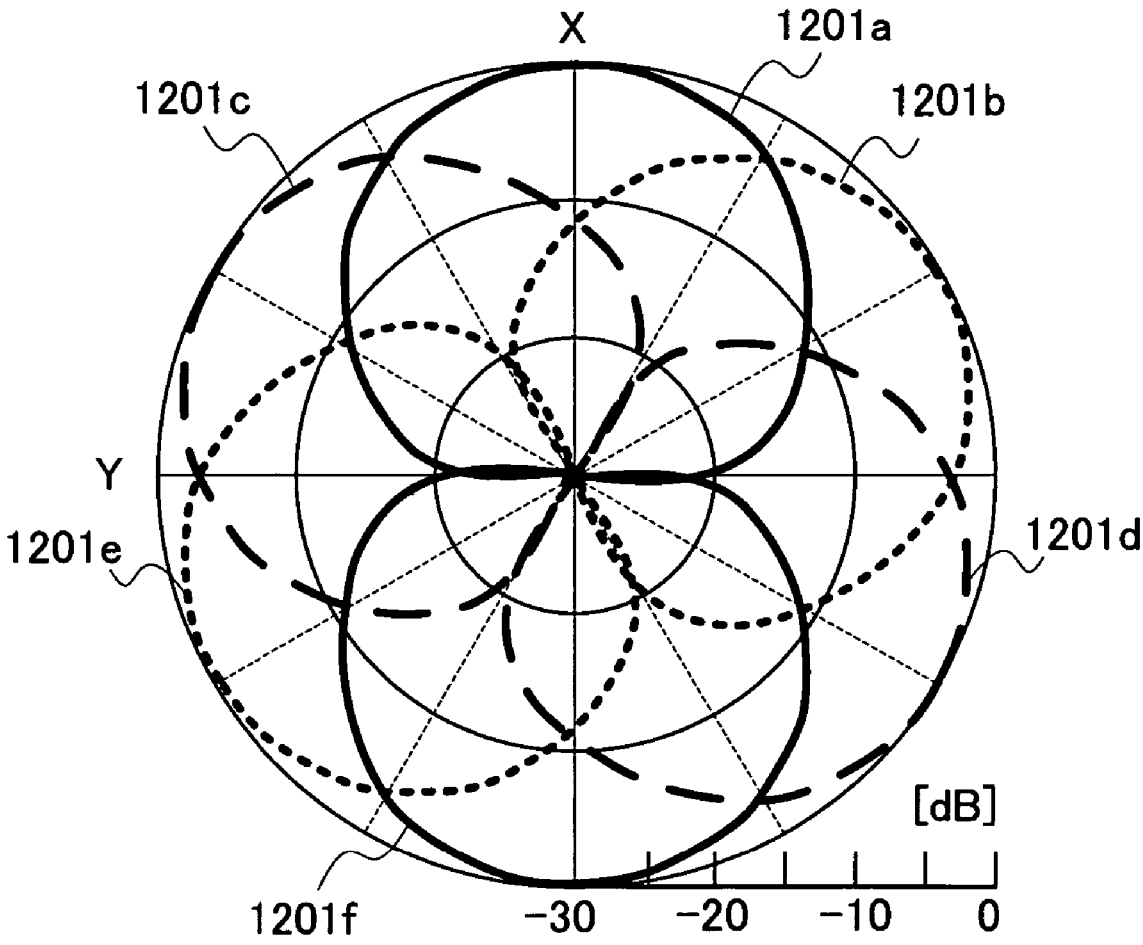
FIG. 14 is a view showing the directivity of the antenna device according to Embodiment 5 of the present invention.

FIG. 14 is a view showing the directivity of the antenna according to the embodiment 5 of the present invention. In the figure, directivities 1201*a* to 1201*f* of the vertically-polarized wave (Eθ) components of the slot diamond-shape antennas 1101*a* to 1101*f* with delay elements on the conical surface are shown.

As known from FIG. 14, the directivities have been formed in the directions, which are shifted by 60°, on the horizontal (X-) plane. At the middle point between two adjacent sectors (for example, in the direction at an angle of 30°), only the minimum gain can be achieved but it is still just −3 [dB] less than that of the maximum gain in this direction. This means that higher gains may be achieved in all the radial directions.

By selectively feeding power to the slot diamond-shape antennas with delay elements 1101*a* to 1101*f* configured as aforementioned, switching may be achieved among the sectors obtained by dividing 360° on the horizontal plane by six. This provides the six-sector antenna.

Thus, according to the embodiment 5 of the present invention, by placing six slot diamond-shape antennas with the delay elements on the rectangular plane while rotating them by 60° and selectively feeding power to the antennas, higher gains may be achieved in all the radial directions, providing a small six-sector antenna.

Note that in the embodiment 5, the method for achieving the six-sector antenna has been mentioned but the present invention is not limited to this type of antennas and may be applicable to the method for manufacturing a plurality of sector antennas.

Although in the embodiment 5, the antenna device shown in the embodiment 3 has been mentioned, the antenna device described in any other embodiment may be used.

The antenna device of the present invention comprises four linear elements, each of which has a length equivalent to a half wavelength of an operating frequency, the elements being placed so that they may draw a diamond shape on a plane, a feeding section that feeds power to one end of a first linear element and one end of a second linear element, the section being put at one of the apexes of a diamond shape, a first delay section connected to the other end of the first linear element and one end of a third linear element for delaying the phase of an antenna current by a given phase, a second delay section connected to the other end of the second linear element and one end of a fourth linear element for delaying the phase of an antenna current by the same phase as that of the first delay section, and a reflector placed at a given distance in parallel to a plane, on which the linear elements have been placed.

Since according to this configuration, the phases of the antenna currents are delayed by the given phase component by means of the first delay means and the second delay means, the phases are shifted between the antenna currents flowing on the first and second linear elements and between the antenna currents flowing on the second and fourth linear elements. This composes an electric wave radiated and an electric wave reflected at the reflector, achieving the antenna device capable of forming the primary beam tilting toward the horizontal place.

In the aforementioned configuration of the antenna device of the present invention, the first delay section and the second delay section have a length within a given range, the sections being linear elements having a bent form.

According to this configuration, by changing the length of the bent linear elements to any other one within the given limits, the amount of delayed phase component of the antenna current may be varied, resulting in a tilt angle modified to a desired one.

In the aforementioned configuration of the antenna device of the present invention, the first delay means and the second delay means are lumped constant parts.

According to this configuration, by changing the lumped constant of the lumped constant parts to any other one, the amount of delayed phase component of the antenna current may be varied, resulting in a tilt angle modified to a desired one.

The aforementioned configuration of the antenna device of the present invention comprises: at least one director element having a length equivalent to a half wavelength or less, the director element being placed at a given distance from an open end of the linear element.

According to this configuration, the radio wave radiated from the diamond-shape antenna device may be converged toward the director element, improving the gain in the direction of the director element.

The antenna device of the present invention comprises two linear elements having the same length, a bending part formed by bending the two linear elements at the centers of the elements with a length within a given range, a feeding section connected to one end of the two linear elements to feed power, and the reflector placed at a given distance in parallel to a plane containing the two linear elements, wherein the two linear elements are bent and placed so that they draw a diamond shape, of which one side has a length equivalent to a half wavelength of an operating frequency and the other ends of the two linear elements are open.

According to this configuration, by inserting two bent linear elements, the diamond-shape with delay elements may be formed, enabling the antenna device to be assembled using less number of parts. This makes easy the process of manufacturing antenna devices.

The antenna device comprises a dielectric substrate with a given dielectric constant, a conductor layer formed on the dielectric substrate, a diamond-shape slot element formed on the conductor substrate, of which each side has a length equivalent to a half wavelength of an operating frequency, the first delay section and the second delay section, which have been placed at each of opposite apex pairs of the diamond shape to delay the phase of an antenna current, the feeding section, which have been placed on either of another one of the opposite apex pairs of the diamond shape, for feeding power to the slot elements, a termination part formed at the other of another one of the opposite apex pairs of the diamond shape, for terminating the slot elements, and the reflector placed beyond the substrate at a given distance from and in parallel to the conductor layer.

Since according to this configuration, the delay means delay the phases of the antenna currents, the phases may be out of phase between the antenna currents flowing through the slot element from the feeding means to the delay means and flowing through the slot element from the delay means to termination part. This composes the electric wave radiated and the electric wave reflected at the reflector, achieving the antenna device, which may form the primary beam, of which vertically-polarized wave tilts toward the horizontal plane.

In the aforementioned configuration of the antenna device of the present invention, the first delay section and the second delay section are the slot elements having a bent form with a length within the given range, which are formed on the conductor layer.

Since according to this configuration, by changing the length of each of the bent slot elements to any other one within the given limits, the amount of the delayed phase component of the antenna current, resulting in the modified tilt angle. This brings the desired tilt angle.

In the aforementioned configuration of the antenna device of the present invention, the feeding section feeds power using a micro strip line laid on a rear plane of the substrate, on which the conductor layer has been formed.

According to this configuration, the feeding means may feed power to the slot elements with impedances well-balanced, providing not only easier power feed but also a further miniaturized antenna device.

In the aforementioned configuration of the antenna device of the present invention, at least one director slot element with a length equivalent to a half wavelength or less, which has been formed at a given distance from the termination part of the slot element.

According to this configuration, the radio wave radiated from the diamond-shape antenna device may be converged toward the director element, improving the gain in the direction of the director element.

The sector antenna of the present invention has been configured so that a plurality of antenna devices according to claim 1 are used, the antenna devices being placed on a plane while being shifted at equal angle from each other.

According to this configuration, the sector antenna capable of forming the primary beam advancing toward the desired direction may be achieved.

In the aforementioned configuration of the sector antenna of the present invention, six antenna devices have been placed in a row on a given rectangular plane, the six antenna devices being shifted by 60° from each other.

According to this configuration, by rotating the diamond-shape six antenna devices by 60° relative to adjacent ones when being placed on the rectangular place, a six-sector antenna capable of forming the primary beams advancing toward six different directions at an equal interval may be obtained, achieving a sector antenna suitably mounted on any of small wireless apparatuses.

As aforementioned, according to the present invention, the open-end diamond-shape antenna, of which one side has a length equivalent to half a wavelength, wherein the delay elements are placed at each of the opposite apex pairs and a reflector is inserted at a given distance in parallel to the plane, in which the elements are place, may form the primary beam, of which horizontally-polarized or vertically-polarized wave tilts toward the horizontal plane. In addition, the diamond-shape antennas with delay elements may be rotated at an even angle when being placed on the rectangular plane, achieving a sector antenna suitably mounted on any of small wireless apparatuses.

This specification was prepared based on the patent application No. 2003-022369 filed on Jan. 30, 2003. This statement is specifically contained here.

INDUSTRIAL APPLICABILITY

The present invention may be suitably applied to fixed wireless apparatuses and wireless terminals configured in a wireless LAN system.

The invention claimed is:

1. An antenna device having an open end, the antenna device comprising:

four linear elements, each of which has a length equivalent to a half wavelength of an operating frequency, the elements being placed in a diamond shape on a plane, a feeding section that feeds power to one end of a first linear element and one end of a second linear element, the feeding section being put at one of the apexes of the diamond shape, a first delay section connected to the other end of the first linear element and one end of a third linear element for delaying the phase of an antenna current by a given phase, a second delay section connected to the other end of the second linear element and one end of a fourth linear element for delaying the phase of an antenna current by the same phase as that of the first delay section, and a reflector placed at a given distance in parallel to the plane, on which the linear elements have been placed.

2. The antenna device according to claim 1, wherein the first delay section and the second delay section have a length within a given range and the first and second delay sections being linear elements having a bent form.

3. The antenna device according to claim 1, wherein the first delay section and the second delay section are lumped constant parts.

4. The antenna device according to claim 1, further comprising at least one director element having a length equivalent to a half wavelength of an operating frequency or less, the director element being placed at a given distance from the open end.

5. A sector antenna device, wherein a plurality of antenna devices according to claim 1 are used, the antenna devices being placed on a plane while being shifted at equal angles from each other.

6. The antenna device according to claim 5, wherein six antenna devices have been placed in a row on a given rectangular plane, the six antenna devices being shifted by 60° from each other.

7. An antenna device comprising:

a dielectric substrate with a given dielectric constant, a conductor layer formed on the dielectric substrate, a diamond-shape slot elements formed on the conductor substrate, of which each side of the diamond shape has a length equivalent to a half wavelength of an operating frequency, a first delay section and a second delay section disposed at each of opposite apex pairs of the diamond shape to delay the phase of an antenna current, a feeding section disposed on either of another one of the opposite apex pairs of the diamond shape for feeding power to the slot elements, a termination part formed at the other of another one of the opposite apex pairs of the diamond shape, for terminating the slot elements, and a reflector placed beyond the substrate at a given distance from and in parallel to the conductor layer.

8. The antenna device according to claim 7, wherein the first delay section and the second delay section are slot elements, having a bent form with a length within a given range, which are formed on the conductor layer.

9. The antenna device according to claim 7, wherein the feeding section feeds power using a micro strip line laid on a rear plane of the substrate, on which the conductor layer has been formed.

10. The antenna device according to claim 7 comprising at least one director slot element, with a length equivalent to a half wavelength of an operating frequency or less, which has been formed at a given distance from the termination part.

* * * * *